US008485702B2

(12) United States Patent
Payne

(10) Patent No.: US 8,485,702 B2
(45) Date of Patent: Jul. 16, 2013

(54) J P SUPPORT SYSTEM

(76) Inventor: John T. Payne, Lima, NY (US)

( * ) Notice: Subject to any disclaimer, the term of this patent is extended or adjusted under 35 U.S.C. 154(b) by 118 days.

(21) Appl. No.: 13/073,950

(22) Filed: Mar. 28, 2011

(65) Prior Publication Data

US 2011/0292665 A1 Dec. 1, 2011

Related U.S. Application Data

(60) Provisional application No. 61/317,947, filed on Mar. 26, 2010.

(51) Int. Cl.
*F21S 8/08* (2006.01)

(52) U.S. Cl.
USPC ..... 362/419; 362/425

(58) Field of Classification Search
USPC ..... 362/418–420, 425
See application file for complete search history.

(56) References Cited

U.S. PATENT DOCUMENTS 6,860,619 B2 * 3/2005 Swanson ..... 362/249.11
2010/0328962 A1 * 12/2010 Liu ..... 362/384

* cited by examiner

*Primary Examiner* — Anh Mai
*Assistant Examiner* — Brenitra M Lee
(74) *Attorney, Agent, or Firm* — Oakwood Law Group, LLP; Yuchien Wei

(57) ABSTRACT

A multi-workstation for use in a work area of a garage having a vertically oriented pole with an upper end and a lower end and a light fixture mounted between the upper end and the lower end of the vertically oriented pole. The light fixture is capable of sliding up and down along the pole, rotating about an axis that is perpendicular to the axis of the pole, moving horizontally toward and away from the pole, and rotating about an axis that is perpendicular to the axis of the pole. Locking means is provided to lock the light fixture at a desired height and angle relative to the pole and mounting means is provided to hold the pole in a vertical position.

1 Claim, 1 Drawing Sheet

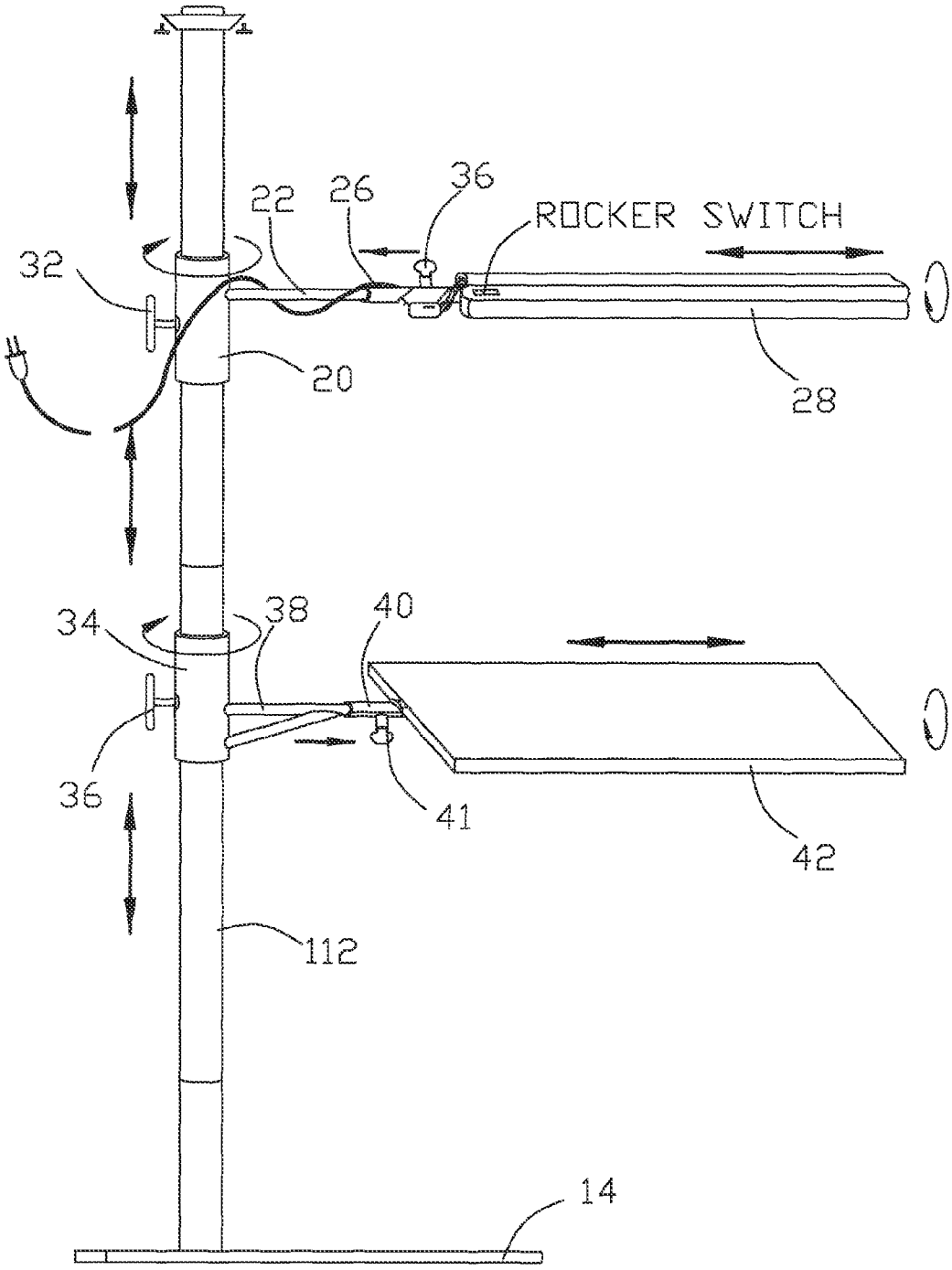
36
22
26
ROCKER SWITCH
32
20
28
34
38
40
36
41
42
112
14

J P SUPPORT SYSTEM

REFERENCE TO RELATED APPLICATIONS

This patent application claims the benefit of U.S. Provisional Application No. 61/317,947 filed on Mar. 26, 2010, the disclosure of which is incorporated herein by reference in its entirety.

BACKGROUND OF THE INVENTION

1. Field of the Invention

The present invention relates generally to a multi-workstation for use in a work area such as in a garage and more specifically to pole mounted support for adjustably supporting a lighting fixture such as a fluorescent light in combination with an adjustably supporting shelf for holding at least a tool or a piece of equipment.

2. Description of Related Art

A multi-workstation having a light and a shelf is known in the prior art. More specifically, by way of example, U.S. Pat. No. 5,906,284 to Hammerstrom discloses a multi-workstation device is provided which includes a vertically-oriented pole and a workstation assembly mounted thereto. The workstation assembly includes a sleeve mounted around the pole, a plurality of arms affixed to and extending radially outward from the sleeve, and a workbench assembly, a light assembly, a winch assembly, a power supply, and an air supply.

SUMMARY OF THE INVENTION

In an exemplary embodiment of the present invention, there is disclosed a multi-workstation for use in a work area of a garage comprising:

a vertically oriented pole having an upper end and a lower end;

a light fixture mounted between the upper end and the lower end of the vertically oriented pole wherein the light fixture is capable of sliding up and down along the pole, rotating about an axis that is perpendicular to the axis of the pole, moving horizontally toward and away from the pole, and rotating about an axis that is perpendicular to the axis of the pole;

locking means coupled to lock the light fixture at a desired height and angle relative to the pole; and mounting means to hold the pole in a vertical position.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows.

Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 1 is a perspective view of a pole mounted multi-workstation for use in a work area such as a garage where the pole rotatably and vertically adjustably supports a lighting fixture having, for example a fluorescent light in combination with a rotatable and vertically adjustably supporting a shelf for holding at least a tool and/or a piece of equipment in accordance with the principles of the invention.

DESCRIPTION OF THE PREFERRED EMBODIMENT

Repair persons often work in cluttered, dimly-lit garages with little room to store equipment and tools. This may limit the repair person' access to essential tools while working, as he/she may need to halt the working process to hunt for one or more specific items. This can be frustrating and time-consuming. The repair person may also have difficulty seeing in their work areas due to insufficient light. Without sufficient light, the worker may not be able to produce optimal results.

To provide extra light which is sufficient to perform the work required, the worker may choose to use a drop light. However, a drop lights may be difficult to position and install properly. In addition the cord that powers a drop light tends to scatter on the ground, putting the worker at risk of tripping over the wire and incurring serious injuries.

Referring to FIG. 1, there is shown a perspective view of a pole mounted multi-workstation for use in a work area such as a garage where the pole rotatably and vertically adjustably supports a lighting fixture having, for example, a fluorescent light and rotatable and vertically adjustably supports a shelf for holding at least a tool and/or a piece of equipment.

The pole support system is designed to hold the necessary equipment and/or tools and provide light for a person doing repair work which functions both as a convenient, substantial light source and a workbench. Thus, with this invention the need for multiple individual work aids is eliminated. Using this invention affords the user unlimited access to necessary tools and equipment by bringing the workbench into the exact desired location and, at the same time Its convenient lighting component also directs light into the specific, isolated work area so that no light is lost or wasted. It is ideal for consumers who repair vehicles or perform other similar types of work.

The invention disclosed provides a workbench and a light source for repair persons, all in one unit. The invention has a rotatable, vertically adjustable work bench and a rotatable, vertically and horizontally extendable adjustable light source each of which is supported on a common vertically positioned pole. The work bench and the light source are rotatably and slidably coupled to the vertically positioned pole with sleeves which can be locked in position with locking means. The sleeves can be freely rotatable around the axis of the stationary pole and may be adjusted to different heights and locked into place a clamp or with thumb set screws.

The light and work bench are also adjustable perpendicularly to the pole, thereby creating another dimension of adjustment. Referring to FIG. 1, a stationary pole 12 which may be a pipe of iron, black iron, plastic, or any metal that is about 2 inches, more or less, in diameter may be mounted to a work bench, installed from the floor to the ceiling, or mounted on a base 14 which may be attached to wheels 16. When the pole is mounted to the base 14, the base may extend outward to receive a counter weight such as a sand bag or an iron or lead weight.

A sleeve 20 measuring about 2 1/16 inches, more or less, in diameter and about 9 inches, more or less in length is slidable and rotatably coupled to the pole 12. A safety lock such as set screws or thumb screws 32 are provided to secure the sleeve 20 in place on the pole 12. A smaller pipe 22, measuring approximately 1½ inches, more or less in diameter and between 6 and 8 ft in length is welded at an angle of about 92 degrees, more or less, to the top of the sleeve 20. Another sleeve 26 which has a length of about 4 feet, more or less is rotatably and slidably coupled to the smaller pipe 22. A small, energy-efficient fluorescent fixture 28 is coupled to the sleeve 26. A safety lock such as set screws or thumb screws 30 are provided to secure the lighting fixture in place. The lighting fixture is capable of rotating around the pipe 22, sliding along the pipe 22, and moving vertically along the pole 12, each being according to users' needs, and to achieve optimal heights and angles.

Located below the sleeve 20 is a sleeve 34 measuring about 2 1/16 inches, more or less, in diameter and about 9 inches, more or less in length is slidable and rotatably coupled to the pole 12. A safety lock such as set screws or thumb screws 36 are provided to secure the sleeve 34 in place on the pole 12. A smaller pipe 38, measuring approximately 1½ inches, more or less in diameter and between 2 and 4 ft in length is welded at an angle of about 90 degrees, more or less, to the top of the sleeve 34. Another sleeve 40 which has a length of about 3 feet, more or less is rotatably and slidably coupled to the smaller pipe 38. A small shelf 42 is coupled to the sleeve 40. A safety lock such as set screws or thumb screws 41 are provided to secure the shelf in place. The shelf is capable of sliding in and out along the pipe 40, and of moving vertically along the pole 12, each being according to users' needs, and to achieve an optimal height.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A multi-workstation for use in a work area of a garage comprising:

a vertically oriented pole having an upper end and a lower end;

a light fixture mounted between the upper end and the lower end of the vertically oriented pole wherein the light fixture is capable of sliding up and down along the pole, rotating about an axis that is perpendicular to the axis of the pole, moving horizontally toward and away from the pole, and tilting about an axis that is perpendicular to the axis of the pole, wherein the light fixture is for a fluorescent light bulb;

locking means coupled to lock the light fixture at a desired height and angle relative to the pole;

mounting means to hold the pole in a vertical position;

a first sleeve slidably and rotatably coupled to the pole to allow the light fixture to slide up and down along the pole and rotate about the axis of the pole;

a pipe extending horizontally out from and attached to the first sleeve, wherein the pipe is attached to the first sleeve at an angle of about ninety two degrees;

a second sleeve rotatably and slidably coupled to the pipe and attached to the light fixture for moving the light fixture horizontally toward and away from the pole, and rotating the light fixture about an axis that is perpendicular to the axis of the pole;

a movable base attached to the lower end of the pole wherein the base is adapted to receive a counter weight;

a shelf coupled to the pole between the first sleeve and the lower end of the pole;

a third sleeve slidably and rotatably coupled to the pole to allow the shelf to slide up and down along the pole and rotate about the axis of the pole;

a pipe extending horizontally out from and attached to the third sleeve; and a fourth sleeve slidably coupled to the pipe and attached to the shelf for moving the shelf horizontally toward and away from the pole.

* * * * *